US007095398B2

(12) United States Patent
Fish

(10) Patent No.: US 7,095,398 B2
(45) Date of Patent: Aug. 22, 2006

(54) DISPLAY DRIVER AND DRIVING METHOD

(75) Inventor: David A. Fish, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 463 days.

(21) Appl. No.: 10/246,170

(22) Filed: Sep. 18, 2002

(65) Prior Publication Data

US 2003/0076288 A1 Apr. 24, 2003

(30) Foreign Application Priority Data

Oct. 19, 2001 (GB) ..... 0125173

(51) Int. Cl.
*G09G 3/36* (2006.01)

(52) U.S. Cl. ..... 345/100; 345/98; 345/555

(58) Field of Classification Search ..... 345/98, 345/100, 555

See application file for complete search history.

(56) References Cited

U.S. PATENT DOCUMENTS 4,748,444 A * 5/1988 Arai ..... 345/99
5,124,688 A * 6/1992 Rumball ..... 345/603
5,298,912 A * 3/1994 Mano et al. ..... 345/88
5,329,292 A * 7/1994 Nishioka et al. ..... 345/589
5,374,957 A * 12/1994 Sharma ..... 348/391.1
5,467,131 A * 11/1995 Bhaskaran et al. .... 375/240.25
5,684,895 A * 11/1997 Harrington ..... 382/233
6,014,122 A * 1/2000 Hashimoto ..... 345/98
6,141,122 A * 10/2000 Ishimaru ..... 358/539
6,157,360 A * 12/2000 Jeong et al. ..... 345/98
6,157,740 A * 12/2000 Buerkle et al. ..... 382/233
6,269,190 B1 * 7/2001 Mikkelsen et al. ..... 382/232
6,281,870 B1 * 8/2001 Hayashi ..... 345/100
6,331,847 B1 * 12/2001 Kim et al. ..... 345/100
6,738,036 B1 * 5/2004 Janssen et al. ..... 345/87
6,836,266 B1 * 12/2004 Kondo et al. ..... 345/103
6,954,200 B1 * 10/2005 Kim ..... 345/204
2004/0073746 A1 * 4/2004 Fallon ..... 711/111

* cited by examiner

*Primary Examiner*—Richard Hjerpe
*Assistant Examiner*—M. Fatahiyar

(57) ABSTRACT

A display driver has a data input (18) for compressed data and a plurality of output (41) for driving respective column lines of a display. By accepting compressed data, the necessary data rate provided to the display driver can be reduced. A plurality of decode modules (48) may be provided connected to respective outputs (41) for decoding compressed data in parallel.

20 Claims, 6 Drawing Sheets

DISPLAY DRIVER AND DRIVING METHOD

The invention relates to displays and in particular to methods of driving matrix type displays and the corresponding displays.

Matrix type displays, for example liquid crystal displays or arrays of light-emitting diodes and of both the passive and active matrix type are used in a wide variety of applications. These include in particular portable applications such as mobile telephones, electronic books and laptops powered by batteries.

As display resolution increases the rate at which data needs to be transferred to the display increases. This consumes greater power and causes electromagnetic interference problems. Although increased power drain is an issue in all devices, it is particularly important for battery powered devices.

There is accordingly a need to address the problem of delivering increased data rates to displays.

According to the invention there is provided a column driver for driving a matrix array of pixel display elements arranged as a plurality of rows and columns and a plurality of signal lines arranged as row lines along the rows and column lines along the columns of the pixel display elements for driving the pixel display elements, the column driver comprising a data input for accepting a compressed image data signal; a plurality of outputs for connection to respective column lines, and at least one decoder for at least partially decompressing the compressed data signal and outputting the decompressed data on respective column lines.

By driving the display with compressed data the data rate that is required to be transmitted to the display is reduced. The display may be a simple passive matrix type display or an active matrix display.

The skilled practitioner will be familiar with prior techniques for coding and decoding compressed image data. For example, the facsimile transmission standard of the CCITT (Comite Consultatif International de Telephonie et Telegraphy) for Group 3 facsimile transmission uses compressed data. However, the prior art approaches for decompressing data of which the applicants are aware involve decompressing the data first, for example using a computer, and then transmitting the data to drive the display. In addition, decompressed data may be stored in a frame store before transmitting the data to a display Accordingly, these prior data compression techniques do not address the question of driving the display, since the display is still driven by uncompressed data.

It is possible to directly drive the display with compressed data without requiring any data line to carry all of the decompressed data since the decompressed data for each column is output on a respective output which is connected, in use, to a respective column line.

In preferred embodiments of the invention, the decoder or one of the decoders uses run length encoded data. Particularly preferred embodiments use cumulative run length encoding.

Preferably, the column driver includes a plurality of decoders each connected to a respective column line. This reduces the clock speed required to carry out the computation for decompressing the data. If this were not done, processing would generally need to be carried out at a higher clock speed than the rate at which compressed data arrives since more than one operation generally needs to be carried out on each element of the compressed data. A lower clock speed means that a unit including such decompression has a lower electrical power requirement than would otherwise be the case, thereby making the decompression more suitable for battery powered devices.

The decoders may be connected to the corresponding column signal lines in parallel.

It should be noted that in the present specification the term "row" is used to describe the direction on the matrix display which the lines of input data address, and "column" describes the direction of the lines driven in parallel by the decoder without implying any particular arrangement or orientation of the display.

Each decoder may include a first input for accepting a cumulative run length signal; a second input for accepting a data signal; a comparator for outputting a clock signal when the cumulative run length signal on the first input exceeds a predetermined index; and a latch having a latch input connected to the second input, a clocking input connected to the comparator and an output, for latching the output signal to be the data signal on the second input when triggered by the clock signal from the comparator.

In this way, each decoder may decode the cumulative run length signal for its column without needing data for other columns.

In embodiments of the invention, a look up table module between the data input and the decoders is provided for partially decoding the compressed data signal on the data input. This is particularly suitable for decoding data that is compressed both using row length coding and then Huffman coding. The look up table module may carry out the first decoding step of decoding the Huffman-coded data to obtain decoded run length parameters that may be fed to the parallel decoders for decoding the run length coding.

The look up table module may also be arranged to detect an end-of line code. The column driver may further include a latch array on the outputs of the parallel decoders; and a latch signal line from the look up table module to a clocking input on the latch array; wherein the look up table module is arranged to detect an end of line code word on the input data and to output a signal along the latch signal line to clock the latch when it detects an end of line code. In this way, each row of data may be latched in turn.

The column driver may provide a plurality of decoders for each of the column lines, each of the decoders outputting one of the bits of a multi-bit signal.

In order to drive each of the columns of pixels with a plurality of bits, the column driver may include at least one decoder for each of the column lines, a plurality of latches for each of the column lines; and a switch box between the decoders and the plurality of latches, the switch box being switchable between a plurality of switch modes, each of the modes connecting, for each column line in parallel, the output of the at least one decoder to a selected latch or latches from the plurality of latches of the respective column line.

Alternatively or additionally, the column driver may include a plurality of decoders for each of the column lines; and a plurality of latches for each of the column lines, wherein the decoders of each column line are connected in parallel to the latches of the respective column line.

The invention also relates to a display including a matrix array of pixel display elements arranged as a plurality of rows and columns; a plurality of signal lines arranged as row lines along the rows and column lines along the columns of the pixel display elements for driving the pixel display elements; and a column driver as described above having respective outputs connected to respective column lines.

The display may include a clock that clocks the decoders at a clock rate no higher than the arrival rate of compressed rate data.

In another aspect, the invention relates to a method of decoding compressed data in a display having a plurality of rows and columns of display pixels, the method comprising: supplying encoded image data to a column driver; decoding the image data in the column driver; and driving the columns of the display in parallel.

In embodiments, the image data is at least partially decoded in parallel for each column line.

The decoders are preferably clocked at a clock speed no higher than the data rate of the supplied encoded image data.

Specific embodiments of the invention will now be described, purely by way of example, with reference to the accompanying drawings in which.

It will be appreciated that the Figures are merely schematic. The same reference numbers have been used throughout the Figures to indicate the same or similar parts.

Figure 1:
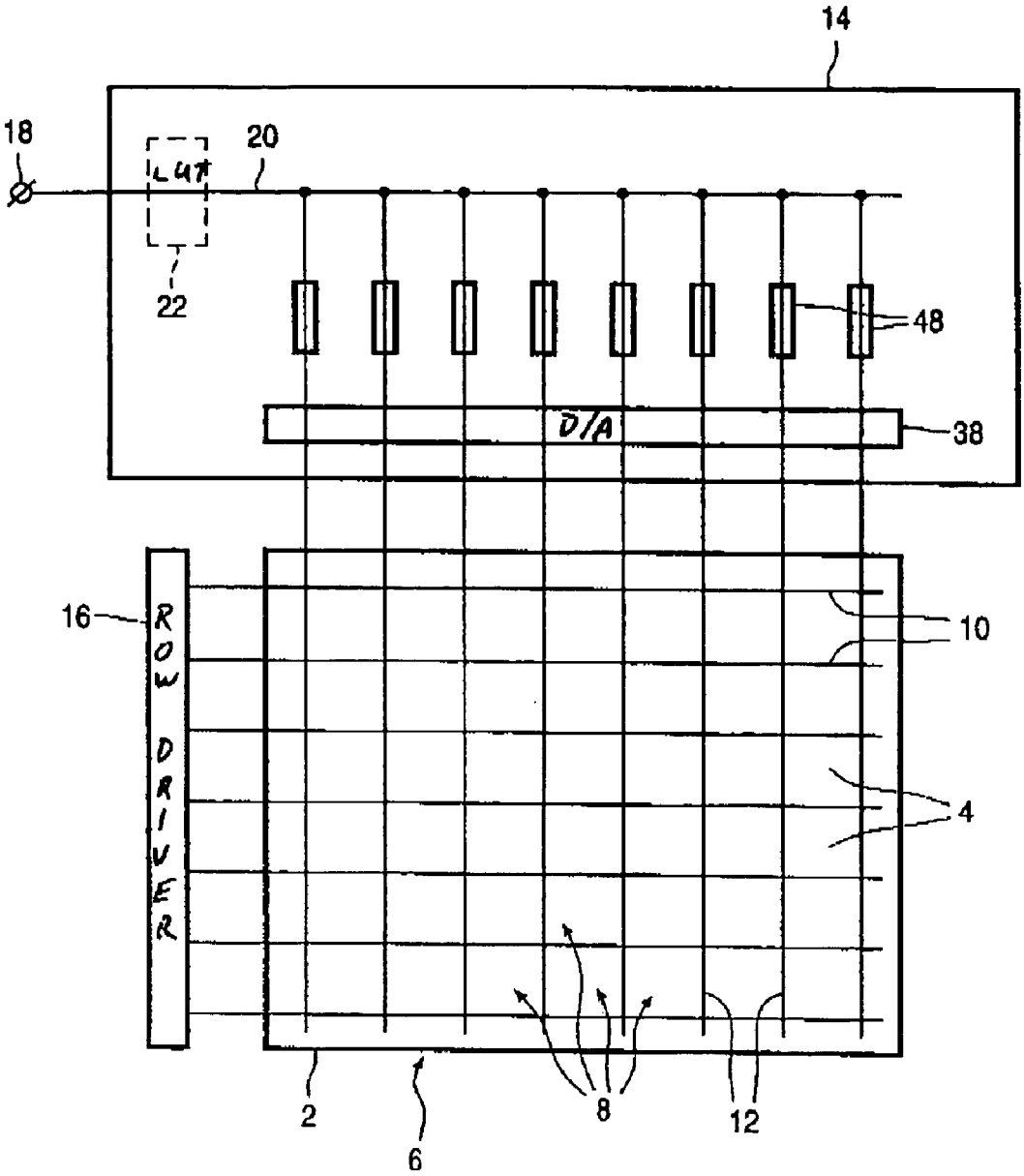
FIG. 1 shows a schematic of a display according to the invention.

A schematic embodiment of a display according to the invention will now be described with reference to FIG. 1. A display includes a matrix array 2 of pixel display elements 8 arranged as a plurality of rows 4 and columns 6. A plurality of signal lines 10, 12 are arranged as row lines 10 and column lines 12. The signal lines 10, 12 provide the electrical signals to drive the display. A number of such matrix display types are known. In particular, the invention is applicable to liquid crystal displays, as well as light emitting diode arrays. The display may be a passive matrix display or an active matrix display, e.g. AMLCD or AMLED.

A column driver 14 and row driver 16 drive the column lines 12 and row lines 10 to create desired images on the display.

A data input 18 is provided on the column driver 14 through which compressed image data can be input. The column driver 14 includes at least one decoder 48 which decodes the compressed input data and driver 38 which drives the respective column lines 12. Additional circuitry may be provided within the column driver; some examples will be presented below.

In use, compressed data is fed to the data input and decompressed, thus reducing the data rate necessary to be fed to the column driver 14.

Compression algorithms in general use data redundancy to reduce bandwidth requirements. A convenient compression algorithm uses run length coding and Huffman coding, as described in the CCITT group 3 binary image compression standard, more normally used for sending faxes. These algorithms will now be briefly described.

Run length coding looks for continuous runs of zeros and ones and codes the image in terms of these runs of zeros and ones. For example, consider the binary image of the letter A:

```
00000000000000000000000000000000
00000000000000111000000000000000
00000000000001111100000000000000
00000000000011101110000000000000
00000000000111000111000000000000
00000000001111111111100000000000
00000000011100000001110000000000
00000000111000000000011100000000
00000000000000000000000000000000
```

The run length code on each row for this image is

Row 0—(0,30)=30
Row 1—(0,14) (1,3) (0,13)=14, 3, 13
Row 2—(0,13) (1.5) (0,12)=13, 5, 12
Row 3—(0,12) (1,3) (0,1) (1,3) (0,11)=12, 3, 1, 3, 11
Row 4—(0,11) (1,3) (0,3) (1,3) (0,10)=11, 3, 3, 3, 10
Row 5—(0,10) (1,11) (0,9)=10, 11, 9
Row 6—(0,9) (1,3) (0,7) (1,3) (0,8)=9, 3, 7, 3, 8
Row 7—(0,8) (1,3) (0,9) (1,3) (0,7)=8, 3, 9, 3, 7
Row 8—(0,30)=30

Each row starts with a zero and the run length code has data that alternates between one and zero for each row. This means that it is not necessary to encode the data bit (the zero or one), only the run length as in the equivalent formulation on the right above. In order to start a run with a one then the first run length, for zero can be given a length zero.

It is generally more convenient to have the run length encoded in a cumulated fashion. Thus, instead of recording as above for row one, 14, 3, 13 a cumulative code is given by 14, 17, 30. The cumulative code is the sum of the codes on each row cumulated to any point and indicates the final character of the string of zero or one rather than the length of the string.

Image data can be further encoded by Huffman coding, which assigns code words to the various characters. The most probable characters are short code words and the least probable characters long code words. Decoding may be achieved with a simple look up table matching the characters and code words. A suitable set of modified Huffman codes are defined in the CCITT group 3 standard.

Thus, to carry out the coding of data firstly the data is run length encoded and then compressed using Huffman coding. The decoding process carries out these two steps in reverse.

A specific embodiment of a column decoder 14 will now be described with reference to FIG. 2.

Data input 18 is connected by input data bus 20 to look up table and control module 22. A clock input 24 is likewise connected to the look up table module 22. The output of the look up table module 22 is connected to a run length decoder 26. A clock generator 28 feeds into the run length decoder 26 and shift register 30, which has an N by 1-bit register. The data from run length decoder 26 is fed into the shift register 30 through data bus 32. The output of shift register 30 is fed to N1-bit latches 34, and then in turn to n1-bit storage latches 36 and, an array of digital-to-analogue converters 38. A signal line 42 connects the look up table module to the storage latches 36. A voltage buffer 40 is connected to outputs 41 each connected to respective column lines 12.

The input data bus 20 may be an m-bit bus where m is the number of bits required to encode the maximum run length, or a single bit bus for serial input data.

In use, data is supplied to input 18 and passes through bus 20 to look up table module 22 which converts the Huffman code to run length codes. In the example, the look up table module uses the CCITT group 3 modified Huffman code.

This code has a special code word for end of line. When the end of line code word is detected, a signal is output down signal line 42 to storage latches 36.

The run length encoded data is output by look up table module 22 to run length module 26 which decodes the run length and passes the decoded data to the inputs of a series of N 1-bit latches 34. The shift register 30 selects which latch is operated.

The storage latches 36 store the data on the N 1-bit latches 34 at the end of every line on receipt of a line end signal from output 37 of the module 22 along signal line 42. The storage latches then drive the DAC 38 through voltage buffer 40.

Accordingly, there is provided a column driver with integral decoding which can reduce the data rate required to be delivered to the column driver on input 18. This reduced data rate can reduce power and electromagnetic interference of the signals.

A clock 25 provides a clock signal on clock input 24. However, this is not sufficiently fast to clock the run length decode module 26 and the shift register 30, since the data rate of the decompressed data is higher than that of the compressed data. Accordingly, the internal clock generator 28 generates a signal 28 from a phase-locked loop having a control input from the look up table module.

The input clock signal on clock input 24 has a clock rate given by fm/μ. or alternatively f/C for the case with a one bit wide input bus 20. F is the uncompressed pixel clock frequency, μ is the average run length and C is the compression ratio. In the case of an m bit wide input bus 20 the clock rate becomes F/μ or alternatively F/Cm.

Figure 2:
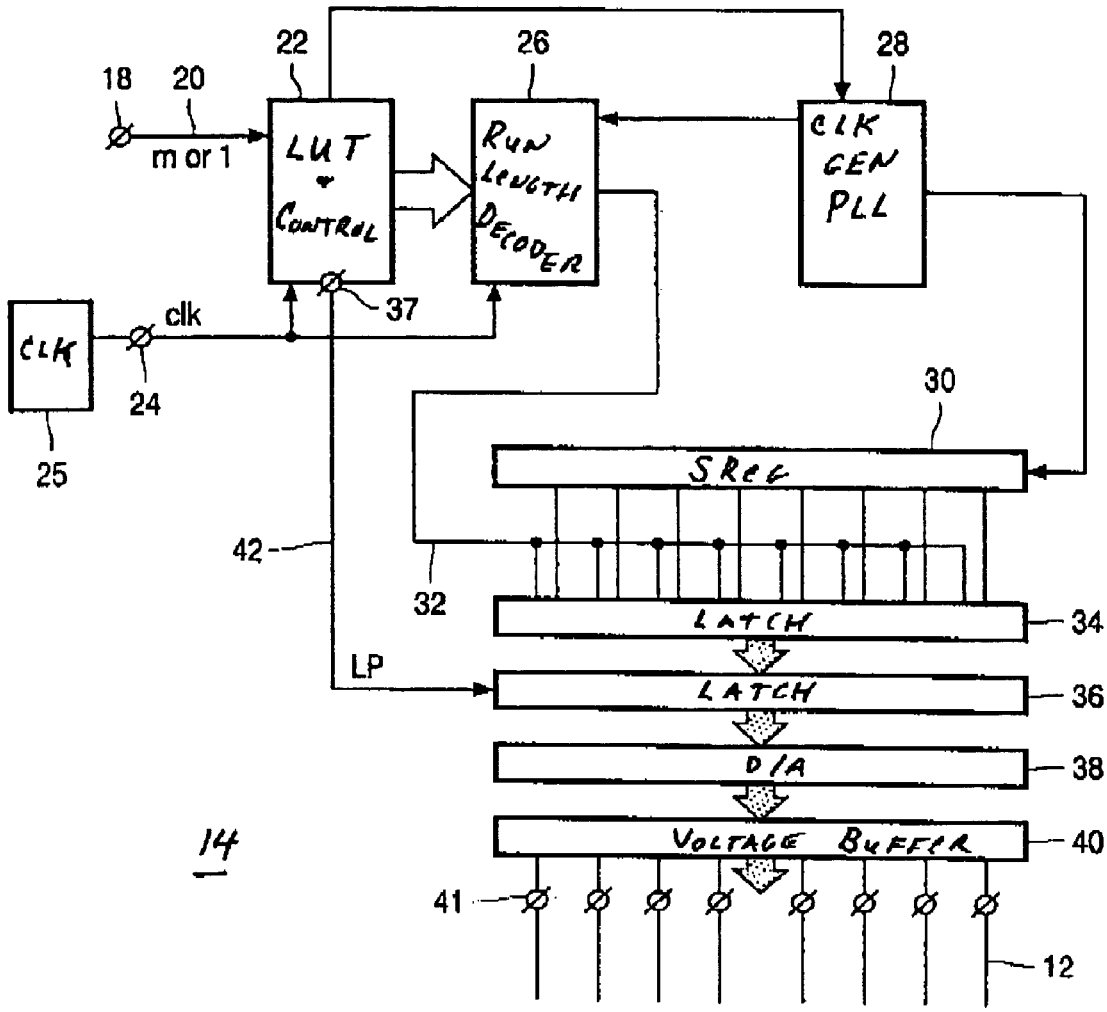
FIG. 2 shows a first embodiment of a column driver according to the invention.
Figure 3:
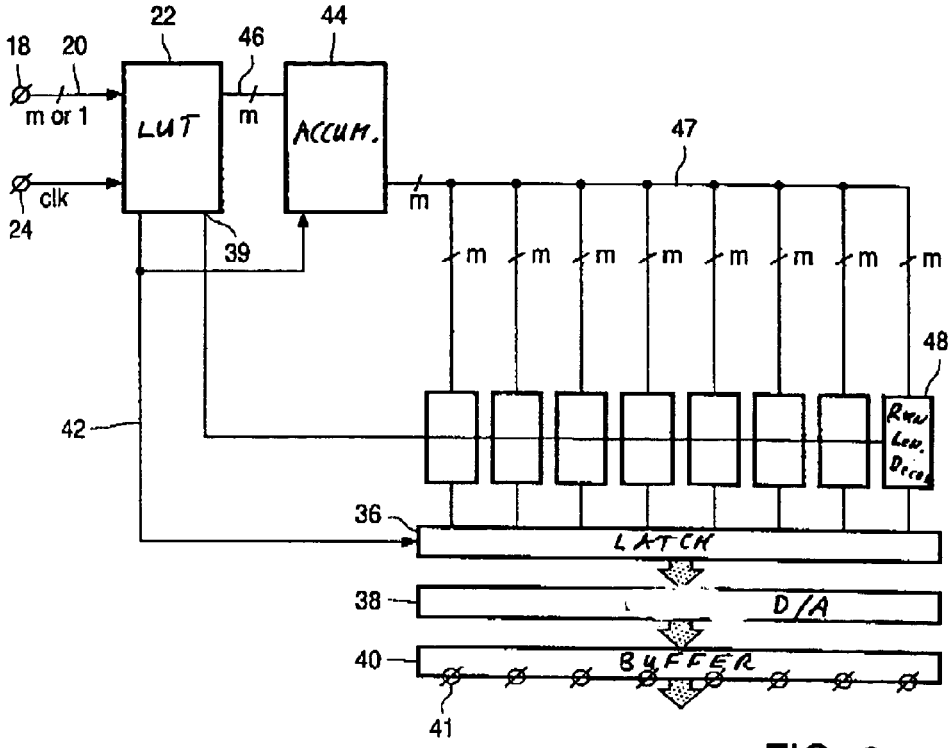
FIG. 3 shows a second embodiment of a column driver according to the invention.

Referring to FIG. 3, an alternative embodiment of a column driver 14 uses parallel run length decoding modules 48. In this arrangement, the output of look up table module 22 is to accumulator 44 along m bit wide data bus 46. The accumulator 44 outputs in parallel along the m bit wide data bus 47 to the parallel decoder modules 48. The parallel decode modules 48 feed into N 1-bit storage latches 36 which record the data at the end of each line when signalled to do so by look up table module 22 along line 42 as in the embodiment of FIG. 2. Data output 39 on the look up table module 22 feeds data into the decode modules 48 as will be explained later.

In use, the accumulator 44 converts the run lengths output by look up table 22 into cumulative run lengths which can be decoded by the decode modules 48 as will be explained below with reference to FIG. 4.

The embodiment of FIG. 3 avoids the need for a high frequency internal clock such as clock generator 28 of FIG. 2. The internal data rate is much reduced by the parallel decode modules. All the data is generated by the cumulative run length data at the input clock speed.

Row and field inversion techniques can easily be added by adding further codes to the lookup table module to signify data plurality. Further logic can be provided to deliver pixel inversion.

Figure 4:
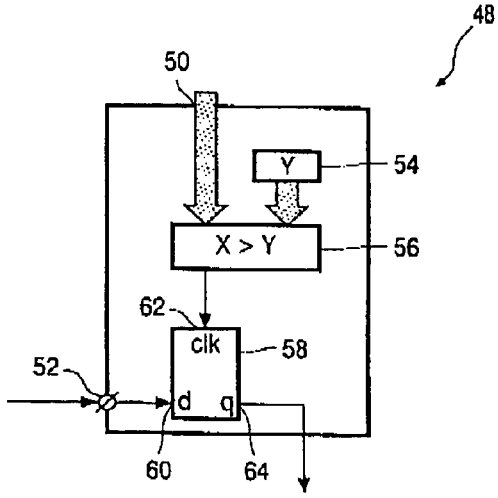
FIG. 4 shows a decoder of the column driver of the embodiment of FIG. 3.

Referring to FIG. 4, a parallel decode module 48 will now be described, suitable for use in the embodiment of FIG. 3. The decode module 48 has a first input 50 for inputting the cumulative run length data output on outputs of the look up table module 22. A second input 52 is provided to accept the data input from data output 39 of the look up table module 22. The data output on output 39 of the look up table is either a "1" or a "0" and indicates whether the cumulative run length data being out relates to a run of "1"s or a run of "0"s. Each decoder module has encoded within it its column number 54, and further contains a comparator 56 and latch 58 having data input 60, clock input 62 and output 64. Comparator 56 clocks latch 60 when the cumulative run length signal exceeds the column number 54.

Figure 5:
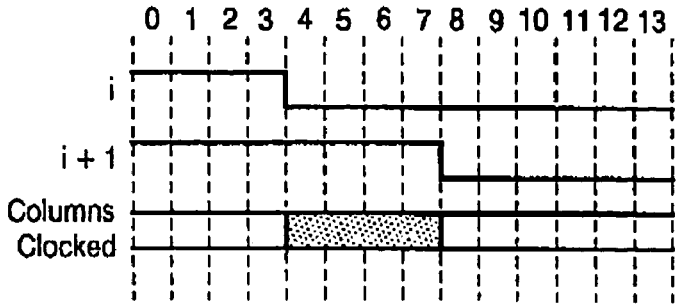
FIG. 5 shows signals illustrating the operation of the decoder shown in FIG. 4.

The operation of the column decoder will now be described with reference to FIG. 5, which shows an example of the clock signals for two successive cumulative run lengths for all columns 1 to 13. The first cumulative length is 3 and the second is 7, and therefore columns 4 to 7 experience a positive change in the clock level when the second cumulative run length of 7 is received. This causes the value of the data bit input on data input 52 to be clocked on columns 4 to 7 to transfer the value of the data bit at that time to the output 64 of the latch.

At the end of each line the cumulative length is set to zero zeroing the clock output of comparator 56 ready for the next line.

The number of lines on data bus 47 to the parallel decoding modules 48 will be large if the display width is large. This can be overcome at the expense of higher data rates by limiting the length of data that can be RL encoded. If for example a display has 1024 columns then 10 lines must be fed to each column decode module plus the data line i.e. 11. If we limit RLs to 64 pixels then we would need 16 of the above described column drivers to cover the whole display. Each column driver would have 64 decode modules with 7 lines into each. The RLs will be divided sequentially in time between the 16 column drivers.

The embodiments described above only require a single bit to address each pixel. However, the invention is also applicable to the driving of grey level images, or colour images, where each pixel has g bits.

Figure 6:
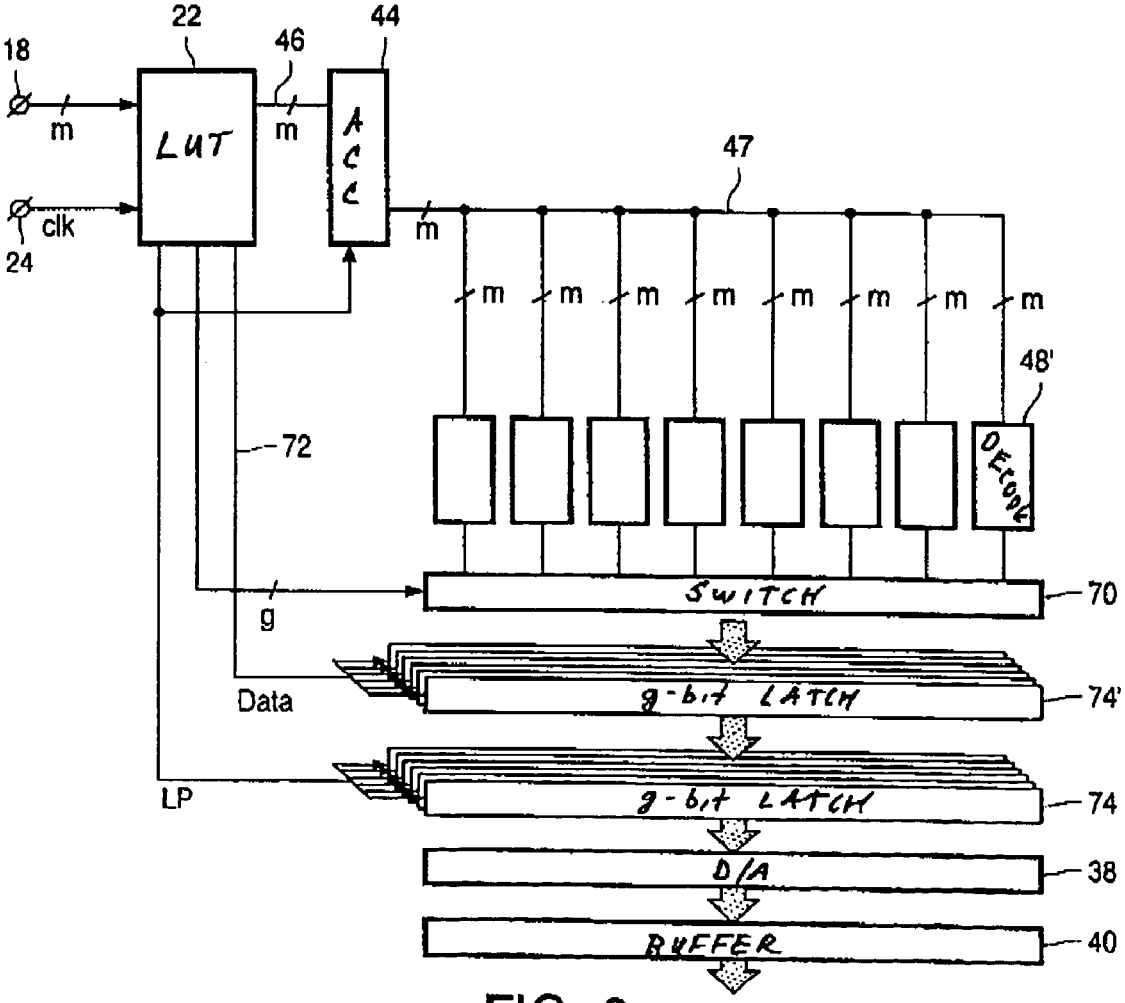
FIG. 6 shows a third embodiment of a column driver according to the invention.

FIG. 6 illustrates a first possible approach based on a modification of the approach illustrated in FIG. 3. Switch box 70 is inserted between parallel decode modules 48' and N g-bit latches 74. The decode modules 48' differ from the modules 48 described previously in that the latches have been separated out to leave column comparison logic. The latches are here implemented instead in g-bit storage latches 74' generally similar to the g-bit latches 74. A switch control line 72 from the look up table module 22 to the switch box 70 allows the look up table module 22 to set the switch box into one of g states, each state connecting the parallel decode modules to a respective one of the g bits of each of the N latches 74' in parallel, and thus directing the decoded clock signal generated by the column comparison logic to the relevant storage latch 74'.

In use, the first N of the (N.g) bits are decoded in parallel and switched into the corresponding N latches, followed by the remainder of the (N.g) bits sequentially. After the full column is decoded, the next column can be decoded, conveniently starting again from the first N of the (N.g) bits.

The clock input of this arrangement operates at an average frequency of fg/mC because each bit plane is sent sequentially, but the codes are sent in parallel. Therefore, compression ratios above one and with more run length bits then grey level bits will give reduced clock/data rates. Since power consumption depends on the number of lines being driven, at first sight it would appear best to make m as large as possible. However, convenient ratios of g/m will be in the range between 0 and 1.

If the selection of a given bit width m for the input bits is not sufficient for the total number of pixels in a row several column drivers may need to be connected together with cumulative run length data being passed to all of the column drivers but only activated when a separate control line activates that particular driver. In this instance, each driver would have $2^m$ columns. With D drivers the average clock/ data rate can become fgD/mC, so the factor gD/m can be optimised for power and data rate reduction. The signals controlling switch box 70 need not be provided by the look up table module 22, but can alternatively be provided by low frequency input control signals.

Figure 7:
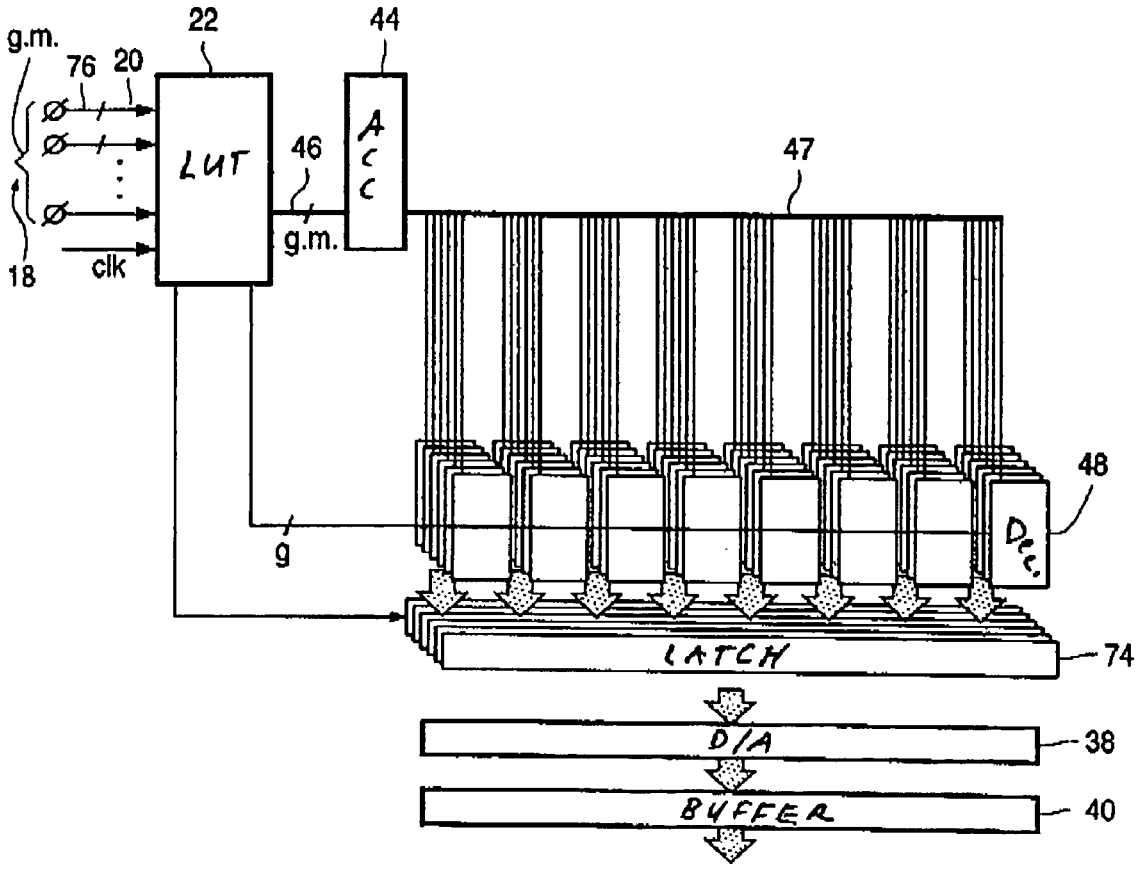
FIG. 7 shows a fourth embodiment of a column driver according to the invention.

Referring to FIG. 7 an alternative embodiment is shown in which input data bus 20 includes a plurality of parallel input data buses 76. There are g input data buses 76, each of bit width m. Internal data buses 46, 47 either side of accumulator 44 each now have the same g by m structure, driving g decode modules 48 for each of the columns. Each of the g decode modules is connected to a respective latch 74. In this arrangement, there is no need for switch box 70 because decoding is carried out in parallel.

Figure 8:
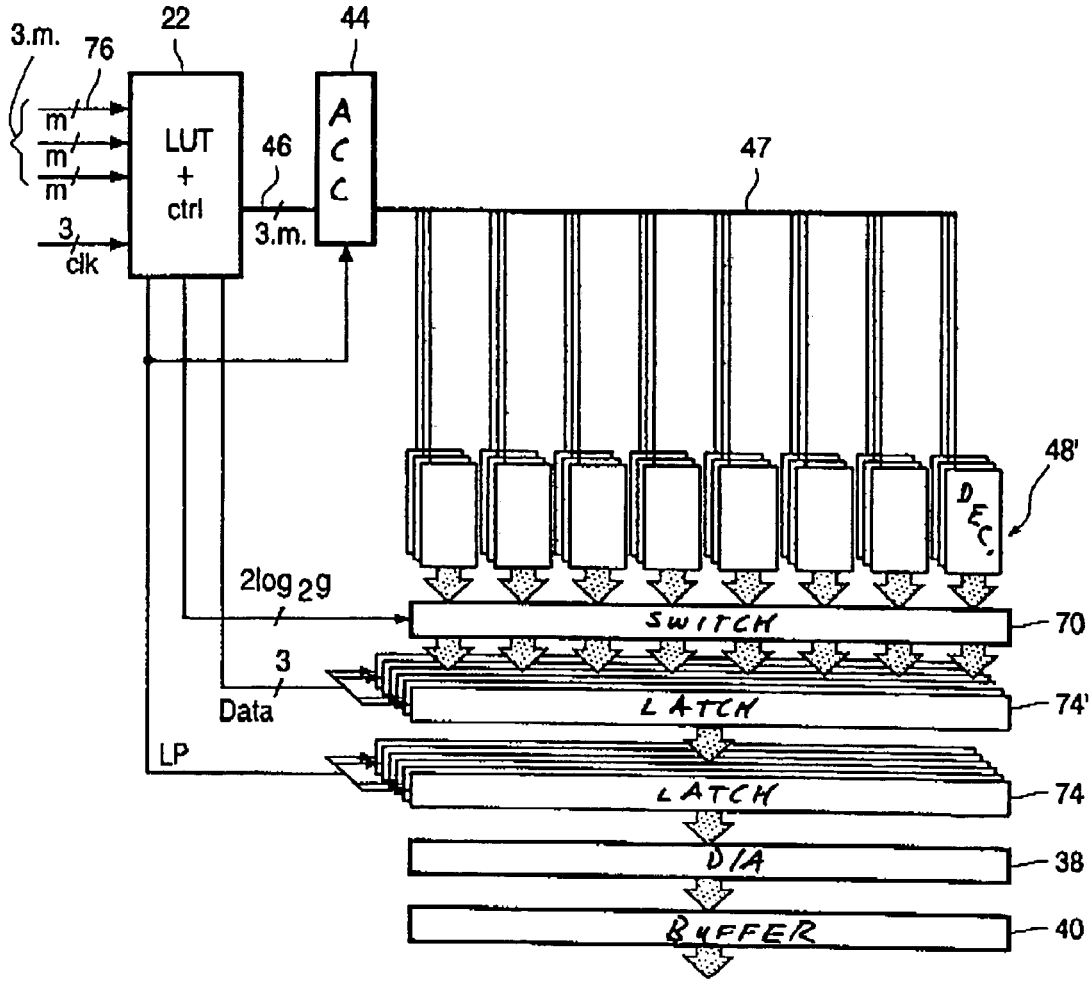
FIG. 8 shows a fifth embodiment of a column driver according to the invention.

A hybrid of the arrangement of FIGS. 6 and 7 can also be provided to trade-off silicon area and data rates. For example, FIG. 8 illustrates an approach with three input data buses 76 and in which internal data buses 46, 47 each have 3 m bits width. A 2 $\log_2 g$ wide bus to a switch box 70 is shown as one possible implementation. There are three decode modules for each column. Switch box 70 multiplies the 3 decode modules to the required number of N 3 g-bit storage latches 74'.

Notice that the arrangement of FIG. 8 is also suitable for a colour display, in which each of the three bit paths corresponds to a single colour.

From reading the present disclosure, other variations and modifications will be apparent to persons skilled in the art. Such variations and modifications may involve equivalent and other features which are already known in the design, manufacture and use of matrix displays and their driving which may be used in addition to or instead of features described herein.

The invention claimed is:

1. A column driver for driving a matrix array of pixel display elements arranged as a plurality of rows and columns having a plurality of row lines and column lines for driving the pixel display elements, the column driver comprising;

a data input that is configured to accept a compressed image data signal corresponding to a selected row line, a plurality of column outputs operably coupled to respective column lines, and at least one decoder that is configured to at least partially decompress the compressed data signal for output on the plurality of column outputs.

2. The column driver of claim 1, including a plurality of decoders each connected in parallel to a respective column output that is configured to at least partially decompress the compressed data signal and output decompressed data on the respective column outputs.

3. A column driver for driving a matrix array of pixel display elements arranged as a plurality of rows and columns having a plurality of row lines and column lines for driving the pixel display elements, the column driver comprising:

a data input that is configured to accept a compressed image data signal; a plurality of column outputs for connection to respective column lines, and a plurality of decoders each connected in parallel to a respective column output that is configured to at least partially decompress the compressed data signal and outputting the decompressed data on the respective column outputs, wherein each decoder of the plurality of decoders includes:

a first input that is configured to accept a cumulative run length signal;

a second input that is configured to accept a data signal;

a comparator that is configured to output a clock signal when the cumulative run length signal on the first input exceeds a predetermined column index; and a latch that includes a latch input connected to the second input, a clocking input connected to the comparator, and an output, and is configured to latch the output signal to be the data signal on the second input when triggered by the clock signal from the comparator.

4. The column driver of claim 1, including a shift register and a plurality of latches that are configured to distribute the output of the decoder between the plurality of column outputs of the column driver.

5. A column driver for driving a matrix array of pixel display elements arranged as a plurality of rows and columns having a plurality of row lines and column lines for driving the pixel display elements, the column driver comprising:

a data input that is configured to accepta compressed image data signal; a plurality of column outputs for connection to respective column lines, at least one decoder that is configured to at least partially decompress the compressed data signal for output on the plurality of column outputs, and a look up table module between the data input and the at least one decoder that is configured to decode a Huffman-coded compressed data signal on the data input.

6. The column driver of claim 5, including:

a latch array on the outputs of the at least one decoder; and a latch signal line from the look up table module to a clocking input on the latch array that is configured to transmit an signal from the look up table module to the latch army to clock the latch when the look up table module detects an end of line code word in the input data.

7. The column driver of claim 1, including:

at least one decoder for each of the columns, a plurality of latches for each of the columns; and a switch box between the decoders and the plurality of latches, the switch box being switch able between a plurality of switch modes, each of the modes connecting, for each column line in parallel, the output of the at least one decoder to a selected latch or latches from the plurality of latches of the respective columns.

8. The column driver of claim 1, including:

a plurality of decoders for each of the columns; and a plurality of latches for each of the columns, wherein the decoders of each columns are connected in parallel to the latches of the respective column line.

9. A display, comprising:

a matrix array of pixel display elements arranged as a plurality of rows and columns;

a plurality of signal lines arranged as row lines along the rows and column lines along the columns of the pixel display elements for driving the pixel display elements;

a row driver that is configured to selectively drive the row lines; and a column driver that includes:

a data input that is configured to accept a compressed image data signal corresponding to a selected row line, and at least one decoder that is configured to at least partially decompress the compressed data signal for output on respective outputs connected to respective column lines.

10. The column driver of claim 1, including a clock that clocks the at least one decoder at a clock rate no higher than the processing rate of compressed rate data.

11. A method of decoding compressed data in a display having a plurality of rows and columns of display pixels, comprising:

supplying the compressed data corresponding to a selected row to a column driver;

decoding the compressed data to form image data in the column driver; and driving the columns of the display based on the image data in parallel.

12. The method of claim 11, including at least partially decoding the compressed data in parallel for each column line.

13. The method of claim 12, including decoding Huffman-encoded data within the compressed data in a look up table to obtain Huffman-decoded data and decoding the Huffman-decoded data in parallel to drive each column line.

14. The method of claim 11, including clocking decoders at a clock speed no higher than the data rate of the supplied compressed data.

15. The column driver of claim 5, including a plurality of decoders each connected in parallel to a respective column output and is configured to at least partially decompress the compressed data signal and output decompressed data on the respective column outputs.

16. The column driver of claim 15, wherein each decoder of the plurality of decoders includes:

a first input that is configured to accept a cumulative run length signal;

a second input that is configured to accept a data signal;

a comparator that is configured to output a clock signal when the cumulative run length signal on the first input exceeds a predetermined column index; and a latch that includes a latch input connected to the second input, a clocking input connected to the comparator, and an output, and is configured to latch the output signal to be the data signal on the second input when triggered by the clock signal from the comparator.

17. The column driver of claim 5, including a shift register and a plurality of latches that are configured to distribute the output of the decoder among the plurality of column outputs of the column driver.

18. The column driver of claim 5, including;

at least one decoder for each of the columns, a plurality of latches for each of the columns; and a switch box between the decoders and the plurality of latches, the switch box being switchable among a plurality of switch modes, each of the modes connecting, for each column line in parallel, the output of the at least one decoder to a selected latch or latches from the plurality of latches of the respective columns.

19. The column driver of claim 5, including:

a plurality of decoders for each of the columns; and a plurality of latches for each of the columns, wherein the decoders of each columns are connected in parallel to the latches of the respective column line.

20. The column driver of claim 3, including a shift register and a plurality of latches that is configured to distribute the output of the decoder among the plurality of column outputs of the column driver.

* * * * *